US006252574B1

(12) United States Patent
Hosoi et al.

(10) Patent No.: US 6,252,574 B1
(45) **Date of Patent: *Jun. 26, 2001**

(54) DRIVING APPARATUS FOR PLASMA DISPLAY PANEL

(75) Inventors: Kenichiro Hosoi; Mitsushi Kitagawa; Takashi Iwami, all of Fukuroi (JP)

(73) Assignee: Pioneer Electronic Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/099,412

(22) Filed: Jun. 18, 1998

(30) Foreign Application Priority Data

Aug. 8, 1997 (JP) ..... 9-215132

(51) Int. Cl.[7] ..... G09G 3/36; G09G 3/28; H01J 17/49

(52) U.S. Cl. ..... 345/103; 345/60; 313/584

(58) Field of Search ..... 313/584, 585, 313/582; 345/103, 60; 315/169.4, 169.2

(56) References Cited

U.S. PATENT DOCUMENTS 5,410,219 * 4/1995 Takei et al . ..... 315/169.4
5,668,569 * 9/1997 Greene et al. ..... 345/103
5,670,974 * 9/1997 Ohba et al. ..... 345/60
5,745,086 * 4/1998 Weber ..... 345/63
5,754,160 * 5/1998 Shimizu et al. ..... 345/103
5,877,734 * 3/1999 Amemiya ..... 345/60
6,002,381 * 12/1999 Tomio et al. ..... 345/60

FOREIGN PATENT DOCUMENTS 55-88097 7/1980 (JP) .
5-64367 3/1993 (JP) .
5-188877 7/1993 (JP) .
8-160912 6/1996 (JP) .

* cited by examiner

*Primary Examiner*—Mark R. Powell
*Assistant Examiner*—Ryan Yang
(74) *Attorney, Agent, or Firm*—Sughrue, Mion, Zinn, Macpeak & Seas, PLLC

(57) ABSTRACT

Disclosed is a driving apparatus for a plasma display panel comprising a group of pairs of row electrodes divided into a plurality of sub-blocks, and a driving pulse generator provided in each sub-block for supplying a driving pulse to the associated sub-block, thereby eliminating non-uniform luminance distribution on the display surface due to variations in voltage of pulses supplied to row electrode in the respective sub-blocks. Output terminals of the pulse generators in the respective sub-blocks are connected to each other to make the voltage levels of at least sustain pulses constant.

2 Claims, 3 Drawing Sheets

DRIVING APPARATUS FOR PLASMA DISPLAY PANEL

BACKGROUND OF THE INVENTION

1. Field of the Invention

This invention relates to a driving apparatus for a plasma display panel.

2. Description of the Related Art

A plasma display panel (designated as "PDP" hereinafter) is known as an image display that provides a reduction in its thickness and an increase in its screen size. The PDP has a number of effective features not found in conventional CRT displays. There is a need for a reduction in manufacturing cost and an improved quality of the plasma display panel.

Generally, a PDP comprises a plurality of row electrodes arranged in parallel and a plurality of column electrodes extending perpendicularly to the row electrodes. A display cell is provided at each point of the row and column electrodes. Particularly, in a color type of PDP, an additional row electrode is arranged near the row electrode to be paired so as to prevent fluorescent layer in the cell from wearing due to ion impact. Surface discharge between the pair of row electrodes is utilized as a light source for the color type of PDP.

The PDP described above requires a plurality of electrodes and a driving circuit for controlling the display for every cell. For providing a PDP having a larger screen size, an immense amount of discharge current is required. Particularly, the integration of the plurality of driving circuits into one chip requires an IC having a large capacity of power supply. Thus, this is not practical in terms of heat generation and manufacturing cost. To overcome the above problem, a conventional PDP driving apparatus divides the group of pairs of row electrodes into a plurality of sub-blocks in order to reduce a load on one IC. Each of sub-blocks then includes one pulse generator. In addition, a driving apparatus is provided for selectively relaying output pulses from the pulse generator.

However, if there is some difference between impedance and output level of pulses of the pulse generators, the levels of pulses supplied from the driving circuits to the pair of row electrodes may differ from one sub-block to another. In such a case, a problem arises in that a luminance distribution is not uniform on the display surface of the PDP.

OBJECT OF THE INVENTION

A main object of the present invention is to provide a driving apparatus for a plasma display panel wherein a pulse generator in every sub-block supplies a uniform output level to the corresponding row electrodes.

SUMMARY OF THE INVENTION

The foregoing and other problems are overcome and the object of the invention is realized by an apparatus in accordance with embodiments of the invention. The present invention features a driving apparatus for a plasma display panel comprising: a group of row electrodes including a plurality of pairs of row electrodes, said group of row electrodes being divided into a plurality of sub-blocks, each of which includes a plurality of row electrode pairs; a group of column electrodes including a plurality of column electrodes extending perpendicularly to said group of row electrodes; a pulse generator provided in each of said sub-blocks for generating a sustain pulse; and an electrode driving circuit provided in each of said sub-blocks for selectively relaying said sustain pulse supplied from an output terminal of said pulse generator to apply the relayed sustain pulse to row electrodes in said each sub-blocks, wherein each of said pulse generators has the output terminal connected to the rest of said pulse generators. Thus, the output levels of pulses supplied from the pulse generators equals to each other.

BRIEF DESCRIPTION OF THE DRAWINGS

The aforementioned aspects and other features of the invention are explained in the following description, taken in connection with the accompanying drawing figures wherein.

DESCRIPTION OF PREFERRED EMBODIMENTS

Figure 1:
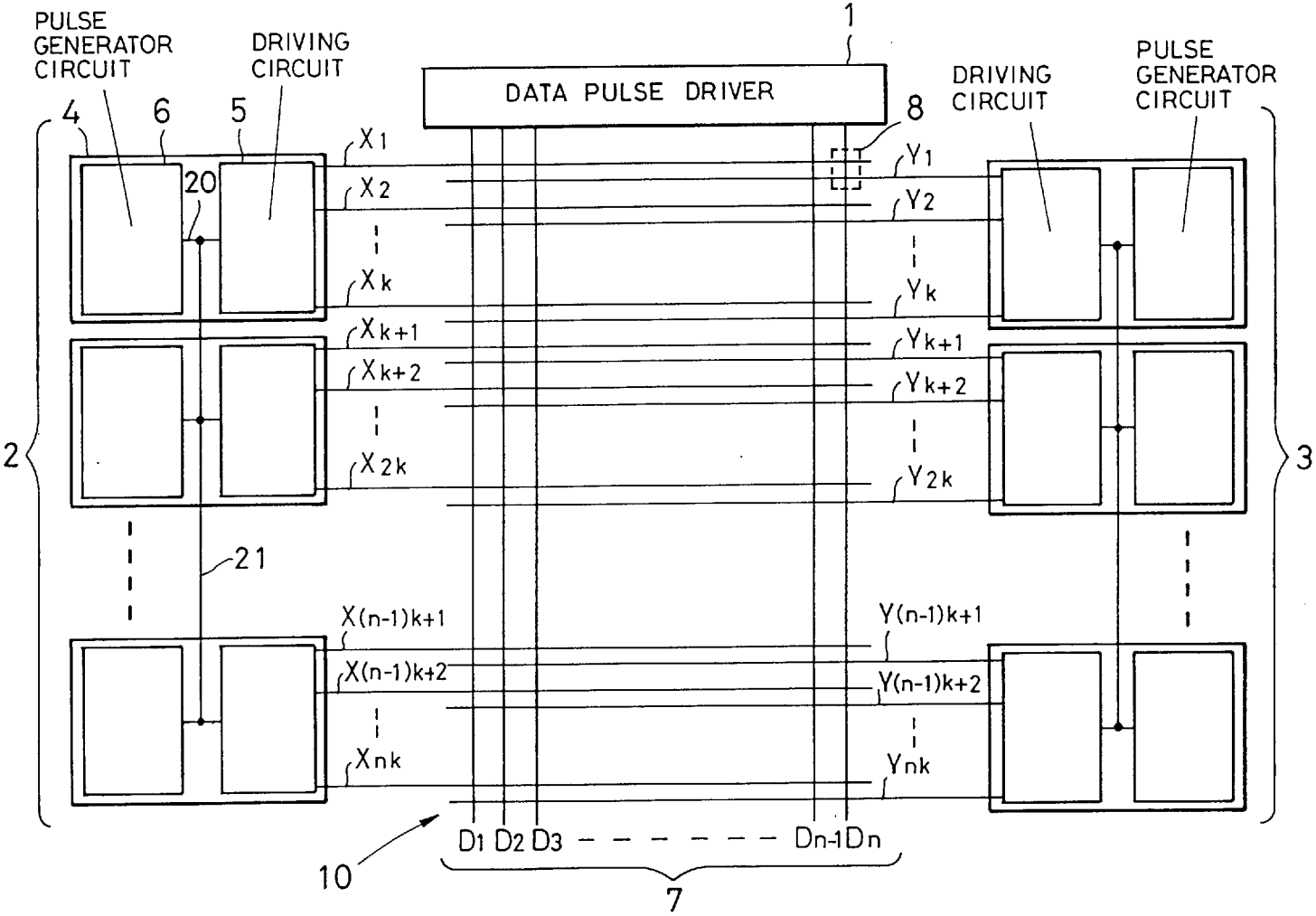
FIG. 1 is a schematic view illustrating a structure of a driving apparatus including a plurality of sub-blocks for a plasma display panel according to the present invention.
Figure 2:
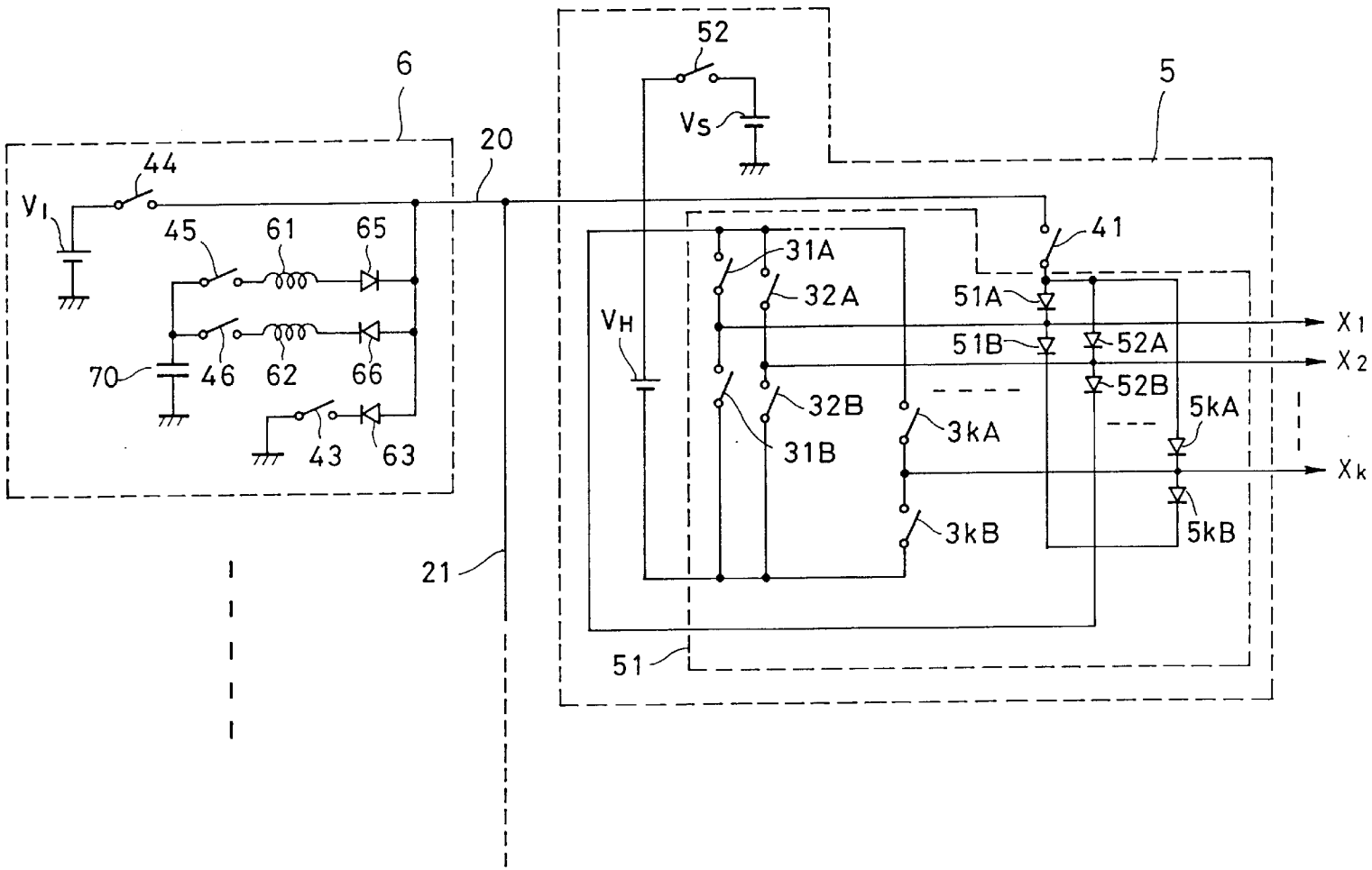
FIG. 2 is circuit diagram illustrating one embodiment of the driving apparatus of FIG. 1.

A preferred embodiment of the present invention will be described with reference to the accompanying drawings. Referring to FIG. 1, a PDP comprises a group of X-row electrodes 2 including a plurality of row electrodes $X_1$, $X_2$, $X_3$, . . . ; a group of Y-row electrodes 3 including a plurality of row electrodes $Y_1$, $Y_2$, $Y_3$, . . . , each of which forms a pair with a corresponding one of the X-row electrode group; and a group of column electrodes 7 including a plurality of column electrodes $D_1$, $D_2$, $D_3$, . . . , which are orthogonal to the X-row electrode group 2 and the Y-row electrode group 3. A display cell 8 is formed at each intersection of the pair of row electrodes and the column electrode. The X-row electrode group 2 is divided into n sub-blocks, each of which includes k row electrodes. The Y-row electrode group 3 is divided into n sub-blocks, each of which includes k row electrodes. A pulse generator 6 is provided in each sub-block for generating a priming (discharge starting) pulse and a sustain pulse. The pulse generator 6 and a driving circuit 5 constitutes an electrode driving circuit 4. The driving circuit 5 selects one of the priming pulse and the sustain pulse from the pulse generator 6 to translate the selected one to the row electrodes. The driving circuit 5 also generates a scanning pulse to supply the scanning pulse to the associated row electrode. The driving circuit 5 is connected to the pulse generator 6 through a lead 20. FIG. 2 illustrates one example of a circuit diagram of the driving circuit 5 and the pulse generator 6. Further, the lead line 20 of each sub-block is interconnected through an equipotential line 21.

FIG. 2 illustrates the circuit diagram of the driving circuit 5 and the pulse generator 6 for generating the scanning pulse, the priming pulse and the sustain pulse to apply these pulses to k row electrodes in each sub-block. FIG. 2 only illustrates the driving circuit 5 and the pulse generator 6 for the X-row electrodes, however, it should be noted that a driving circuit and a pulse generator for the Y-row electrodes have the same configuration as the illustrated one.

The driving circuit 5 includes a driving circuit IC which is indicated by the dotted box 51. For each row electrode, a cathode of a first diode 51A is connected to an anode of a second diode 51B. Anodes of first diodes 51A–5kA are interconnected. Cathodes of second diodes 51B–5kB are connected together to the lead 20. A push switch 41 is connected between the anodes of the first diodes 51A–5kA and the lead 20 which the output from the pulse generator 6 passes through. A plurality of pairs of push switches 31A and 31B, 32A and 32B, . . . , 3kA and 3kB are connected in series between a common higher potential and a common lower potential, respectively. A power supply $V_H$ is connected in parallel with the pairs of push switches 31A and 31B, 32A and 32B, . . . , 3kA and 3kB. Connecting points between the series push switches 31A and 31B, 32A and 32B, . . . , 3kA and 3kB are connected to the cathodes of the first diodes 51A–5kA, the anodes of the second diodes 51B–5kB, and the corresponding row electrodes $X_1$, $X_2$, . . . , $X_k$, respectively. The higher potential terminal of the power supply $V_H$ is connected to the lead 20. A higher potential terminal of the power supply $V_H$ is also connected to a power supply $V_S$ through a switch 52. A lower potential terminal of the power supply $V_S$ is connected to a reference potential.

When the driving circuit 5 controls the switches 41, 52 simultaneously to open the switch 41 and to close the switch 52, and also controls the switches 31A–3kA and 31B–3kB to open and close one of the the switches 31A–3kA and 31B–3kB alternately, the voltage $V_S$ is applied to the row electrodes $X_1$, $X_2$, . . . , $X_k$, respectively if the push switches 31A–3kA are closed, otherwise i.e. if the push switches 31B–3kB are closed, a voltage ($V_S$–$V_H$) is applied. Therefore, the driving circuit 5 can supply a desired scanning pulse during a scanning period.

In the pulse generator 6, a capacitor 70 has one end connected to the reference potential. A switch 45, a coil 61 and a diode 65 are connected in series between the other end of the capacitor 70 and the anodes of the first diodes 51A–5kA of the driving circuit 5. There is the switch 41 between the diode 65 and the anodes of the first diodes 51A–5kA. A switch 46, a coil 62 and a diode 66 are connected in series. A cathode of the diode 65 and an anode of the diode 66 are connected to the anodes of the first diodes 51A–5kA through the switch 41. Further, a power supply $V_I$ and a push switch 44 are connected in series between the reference potential and the anodes of the first diodes 51A–5kA through the switch 41. A diode 63 and a push switch 43 are connected in series. The diode 63 is connected with the power supply $V_I$ in parallel. A higher potential terminal of the power supply $V_I$ is connected to a cathode of the diode 65 and the anodes of the first diodes 51A–5kA. The pulse generator 6 generates the priming pulse and the sustain pulse during a priming period and a sustain period, respectively.

Figures 3A, 3B:
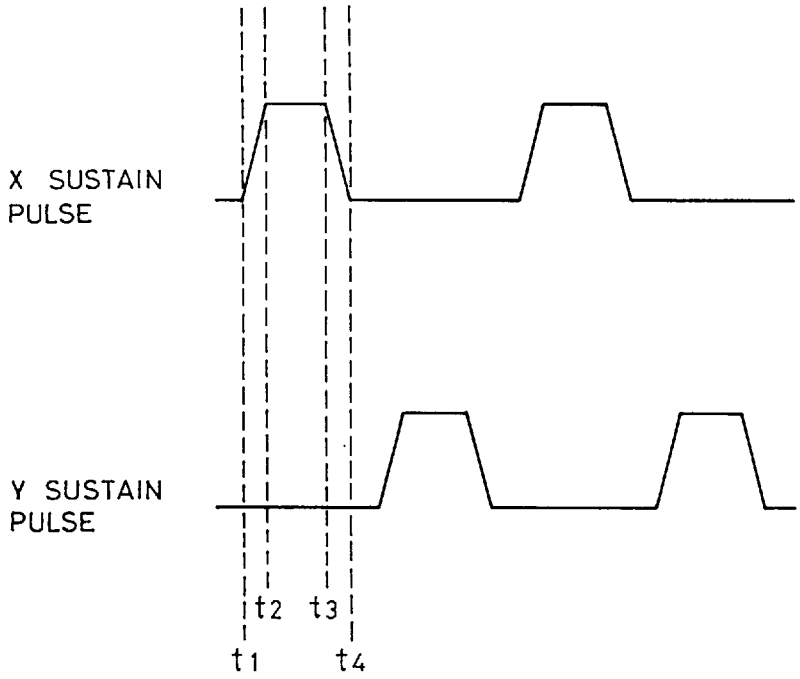
FIGS. 3A and 3B illustrate waveforms of sustain pulses supplied from the pulse generator of FIG. 2.

FIGS. 3A and 3B illustrate waveforms of the sustain pulses generated by the pulse generator 6. In the following, a process of generating the sustain pulses in the sustain period will be described with reference to FIG. 3A.

First, assume that all pairs of the push switches 31A–3kA and 31B–3kB are opened and the switch 41 is closed. Also, assume that the push switch 44 and the switches 45, 46 are all opened, the push switch 43 is closed, and the output of the pulse generator 6 equals the reference potential.

Next, when the switch 45 is closed and the switch 43 is opened, a charge current from the capacitor 70 is supplied to the display cells of the PDP through the diode 65 ($t_1$–$t_2$). Subsequently, when the switch 45 is opened and the push switch 44 is closed, each of the row electrodes is held at a sustain pulse voltage $V_I$ ($t_2$–$t_3$).

Next, when the push switch 44 is opened and the switch 46 is closed, discharge currents from the display cells in the PDP are charged on the capacitor 70 through the diode 66 ($t_3$–$t_4$). Subsequently, when the switch 46 is opened and the pull switch 43 is closed, the outputs of the respective row electrodes are held to the reference potential.

By repeating the operations described above, a series of sustain pulses are supplied to the respective row electrodes through the driving circuit 5. As illustrated in FIG. 3B, a sustain pulse for the Y-row electrode is also generated by similar operations. Because its generating timing is shifted by one half of a cycle from the X-sustain pulse, a surface discharge between a pair of the X and Y row electrodes is caused.

The series of sustain pulses generated by the pulse generator described above are supplied simultaneously to the respective row electrodes, however, each group of the row electrodes is divided into a plurality of sub-blocks to reduce a required amount of current supplied to each sub-block.

The number of pairs of row electrodes included in one sub-block is not necessarily the same for every sub-block. For example, sub-blocks positioned near both ends of the panel may be allotted with a larger number of pairs of row electrodes, and sub-blocks in a central area of the panel may be allotted with a smaller number of pairs of row electrodes.

As described above, since an amount of discharge current required to one driving apparatus IC is reduced, the driving apparatus IC may have a lower power supply capacity, thus facilitating the integration of the driving apparatus into a chip. In addition, since a voltage drop due to the impedance of the lead can be suppressed, the PDP can be utilized as, a large screen display.

Further, the voltage $V_I$ of the pulse generator 6 determines the output levels of the priming pulse and the sustain pulse. The output terminal of the pulse generator 6, i.e., one end of $V_I$ is interconnected to those of the respective sub-blocks to maintain the sub-blocks at the same potential level, whereby the levels of the pulses applied to the respective row electrodes are made equal in all the sub-blocks.

As described above, the group of row electrodes is divided into a plurality of sub-blocks, each of which has one pulse generator to reduce a load on one pulse generator. Also, since the sustain pulses applied to all row electrodes have a constant potential level, the display cells are free from variations in luminance between sub-blocks. A solution is also given to the problem of variations in voltage drop caused due to a variations in impedance of leads which serve as the output terminals of the pulse generators. Furthermore, if any of the pulse generators fails, the pulses are supplied to the sub-block having the failed generator from a pulse generator in any other sub-block. Thus, each of the pulse generators can also serve as a pulse compensating circuit.

Thus, the present invention has been described with reference to the preferred embodiment thereof. It should be understood by those skilled in the art that a variety of modifications and alterations may be made without departing from the spirit and scope of the present invention. All such modifications and alternations are intended to be encompassed by the appended claims.

What is claimed is:

1. A driving apparatus for driving a plasma display panel comprising:

a plurality of first row electrodes extending in parallel with each other;

a plurality of second row electrodes extending in parallel with a corresponding one of said plurality of first row electrodes to make a pair with said corresponding one, the pairs of first and second row electrodes being divided into a plurality of sub-blocks;

a plurality of column electrodes extending perpendicularly to said pairs of first and second row electrodes, each of said column electrodes defining a unit light emitting region including an intersection formed wherever each of said plurality of column electrodes crosses one of said pairs of first and second row electrodes;

a plurality of first pulse generators for generating first driving pulses, each of said plurality of first pulse generators having a first output terminal through which said first driving pulse pass;

a plurality of second pulse generators for generating second driving pulses, each of said plurality of second pulse generators having a second output terminal through which said second driving pulses pass;

a plurality of first electrode driving circuits connected between each of said plurality of first pulse generators and the corresponding first row electrodes, each of said plurality of first electrode driving circuits provided for selectively relaying said first driving pulses to the corresponding first row electrode; and a plurality of second electrode driving circuits connected between each of said plurality of second pulse generators and the corresponding second row electrodes, each of said plurality of second electrode driving circuits provided for selectively relaying said second driving pulses to the corresponding second row electrode, wherein said first output terminal of one of said plurality of first pulse generators is connected to first output terminals of all other of said plurality of first pulse generators and said second output terminal of one of said plurality of second pulse generators is connected to second output terminals of all other of said plurality of second pulse generators.

2. A driving apparatus for driving a plasma display panel according to claim 1, wherein said first driving pulses comprise a priming pulse and sustain pulses, and said second driving pulses comprise a priming pulse and sustain pulses.

* * * * *